United States Patent [19]

Christian et al.

[11] 4,324,671

[45] Apr. 13, 1982

[54] GREASE COMPOSITIONS BASED ON FLUORINATED POLYSILOXANES

[75] Inventors: John B. Christian, Yellow Springs; Christ Tamborski, Dayton, both of Ohio

[73] Assignee: The United States of America as represented by the Secretary of the Air Force, Washington, D.C.

[21] Appl. No.: 233,277

[22] Filed: Feb. 10, 1981

Related U.S. Application Data

[63] Continuation-in-part of Ser. No. 100,180, Dec. 4, 1979, abandoned.

[51] Int. Cl.[3] ..... C10M 1/32; C10M 1/50

[52] U.S. Cl. ..... 252/49.6; 252/51.5 R; 252/390; 252/58

[58] Field of Search ..... 252/49.6, 50, 51, 51.5 R, 252/58, 390, 392; 548/330

[56] References Cited

U.S. PATENT DOCUMENTS

| | | | |
|---|---|---|---|
| 2,961,425 | 11/1960 | Pierce et al. | 260/46.5 |
| 3,088,910 | 5/1963 | Rudel et al. | 252/32.5 |
| 3,642,626 | 2/1972 | Christian | 252/33.6 |
| 3,849,433 | 11/1974 | Butula | 260/308 B |
| 4,040,968 | 8/1977 | Harris | 252/51.5 A |
| 4,071,459 | 1/1978 | Cohen et al. | 252/51.5 R |
| 4,132,660 | 1/1979 | Christian et al. | 252/51.5 R |
| 4,185,965 | 1/1980 | Schlicht et al. | 252/51.5 R |
| 4,267,348 | 5/1981 | Tamborski et al. | 548/330 |

*Primary Examiner*—Patrick Garvin
*Assistant Examiner*—Jacqueline V. Howard
*Attorney, Agent, or Firm*—Donald J. Singer; William J. O'Brien

[57] ABSTRACT

An antirust, anticorrosion grease composition comprising a major amount of a fluorinated polysiloxane base fluid, a minor amount of a fluorocarbon polymer thickening agent, and a rust and corrosion inhibiting amount of a benzimidazole.

14 Claims, No Drawings

GREASE COMPOSITIONS BASED ON FLUORINATED POLYSILOXANES

STATEMENT OF GOVERNMENT INTEREST

The invention described herein may be manufactured and used by or for the Government for governmental purposes without the payment of any royalty thereon.

CROSS REFERENCE TO RELATED APPLICATION

This application is a continuation-in-part of U.S. patent application Ser. No. 100,180, filed Dec. 4, 1979, now abandoned.

FIELD OF THE INVENTION

This invention relates to grease compositions which have a fluorinated polysiloxane as a base fluid and containing an additive which imparts rust and corrosion resistance to the compositions.

BACKGROUND OF THE INVENTION

Because of their extreme pressure and antiwear characteristics, it has been recognized that fluorinated polysiloxane fluids have an excellent potential for use as lubricants. For example, as shown in U.S. Pat. No. 3,642,626, issued to one of us on Feb. 15, 1972, greases formulated from these fluids and thickeners, such as a fluorinated copolymer of ethylene and propylene or a polymer of tetrafluoroethylene, have proven to be useful as lubricants over a wide range of temperatures, e.g., as low as −100° F. and as high as 450° F. Although the prior art greases possess superior lubricating characteristics, their utility has been limited by their inability to provide rust preventive properties under conditions of high humidity and mild temperature (below 212° F.). Also, their utility has been restricted by their inability to furnish anticorrosion properties when employed as lubricants for ferrous metals under conditions of high temperature. It would be very desirable to provide a grease based on a fluorinated polysiloxane fluid that overcomes these problems of rust and corrosion of ferrous metals.

It is a primary object of this invention, therefore, to provide a fluorinated polysiloxane base grease composition that possesses rust and corrosion inhibiting properties.

A further object of the invention is to provide antirust and anticorrosion additives for grease compositions formulated with fluorinated polysiloxane base fluids.

Another object of the invention is to provide grease compositions which do not cause rusting or corrosion of ferrous metals either under mild temperature and high humidity conditions or under high temperature conditions.

Other objects and advantages of the invention will become apparent to those skilled in the art upon consideration of the ensuing disclosure.

SUMMARY OF THE INVENTION

The present invention resides in the discovery that the addition of a small amount of certain benzimidazoles to a fluorinated polysiloxane base fluid and a thickener therefor provides a grease having unexpectedly outstanding properties. Thus, the resulting grease composition inhibits rust formation when utilized as a lubricant for ferrous metals under mild temperature and high humidity conditions. Furthermore, the grease inhibits corrosion when used as a lubricant for ferrous metals under high temperature conditions.

In a more specific embodiment, the instant invention is concerned with a grease composition comprising (1) a major amount of a fluorinated polysiloxane base fluid, (2) a minor amount of a thickener for the base fluid, and (3) a rust and corrosion inhibiting amount of a benzimidazole.

More specifically, the grease composition consists essentially of about 60 to 65 weight percent of base fluid, (2) about 33.5 to 39.5 weight percent thickener, and (3) about 0.5 to 1.5 weight percent benzimidazole, based upon a total of 100 weight percent.

In general, any suitable fluorinated polysiloxane can be used as a base fluid in formulating the grease compositions of this invention. Fluorinated polysiloxane fluids are well known materials which are described in the literature and are commercially available.

It is often preferred to utilize base fluids having the following structural formula:

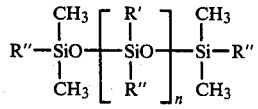

wherein R′ is hydrogen or an aliphatic hydrocarbon radical containing 1 to 3, inclusive, carbon atoms, R″ is methyl, ethyl, vinyl, phenyl or $—CH_2CH_2R'''$ in which R‴ is a perfluoroalkyl radical of 1 to 10, inclusive, carbon atoms with at least half of the R″ groups being $—CH_2CH_2R'''$, and n is an integer ranging from 1 to 150, preferably from 40 to 150. The letter n can also be defined as being an integer having a value such that the fluid has a viscosity of about 50 to 100 centistokes, preferably 65 to 85 centistokes, at 100° F. Fluorinated polysiloxanes as defined by the foregoing general formula as well as a procedure for their synthesis are disclosed in U.S. Pat. No. 2,961,425. Examples of specific polysiloxanes that can be used as a base fluid are described hereinafter by their structural formulas. In general, the polysiloxanes have viscosities, i.e., value of n, as set forth above. Where the repeating units within the brackets of the formulas consist of two different radicals, they are derived by using a mixture of the siloxane compounds.

A polysiloxane that is preferred for use as a base fluid has the following structural formula:

$$CF_3CH_2CH_2Si(CH_3)_2O[\underset{\displaystyle CH_2CH_2CF_3}{\underset{|}{Si}}(CH_3)O]_nSi(CH_3)_2CH_2CH_2CF_3. \qquad (A)$$

Another polysiloxane that can be advantageously used has the following formula:

$$(CH_3)_3SiO[\underset{\displaystyle CH_2CH_2CF_3}{\underset{|}{Si}}(CH_3)O]_{n'}[Si(CH_3)_2O]_{n''}Si(CH_3)_3. \qquad (B)$$

The two siloxane groups within the brackets can be in alternating order or at random or in series of similar repeating units with n′ and n″ representing integers of about the same value and their sum being a value such as to provide a fluid having the above described viscosity. The preferred values of n′ and n″ are in the range of 20 to 75. Other exemplary polysiloxanes useful as base fluids include those having the following formulas:

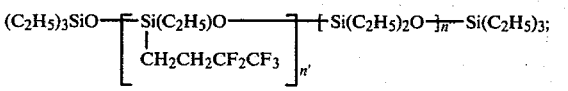

(C)

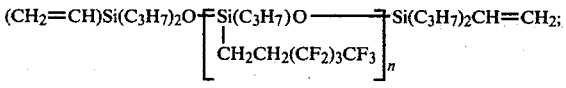

(D)

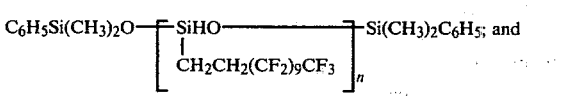

(E)

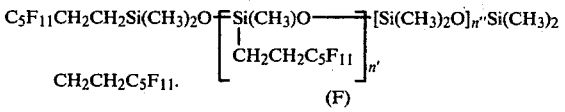

(F)

In the foregoing formulas (C–F), the values of n and the sum of n′ and n″ are such that the polysiloxanes have a viscosity at 100° F. ranging from 50 to 150 centistokes, preferably from 65 to 85 centistokes.

As a thickener, it is generally preferred to use a fluorinated ethylene-propylene copolymer or polytetrafluoroethylene. The copolymer usually has a molecular weight of about 120,000 to 190,000 perferably 140,000 to 160,000 and a density of about 2.39 to 2.47 g/cc. The polytetrafluoroethylene usually has a molecular weight of about 2,000 to 50,000 preferably about 10,000 to 50,000 and a density of about 2.15 to 2.28 g/cc. These polymeric thickeners are well known materials that are described in the literature.

The benzimidazole antirust and anticorrosion additives used in the grease compositions have the following structural formula:

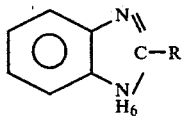

wherein R is H, hydrocarbon alkyl, hydrocarbon aryl, perfluoroalkyl or perfluoroalkyleneether. Examples of hydrocarbon alkyl and perfluoroalkyl groups include those having the formulas $C_aH_{2a+1}$ and $C_aF_{2a+1}$, respectively, where a is an integer from 1 to 10, inclusive. Examples of hydrocarbon aryl groups include phenyl, biphenyl, tolyl, xylyl, and naphthyl. Suitable perfluoroalkyleneether groups include $CF_2(OCF_2CF_2)_yOC_2F_5$, where y is zero or an integer from 1 to 10, inclusive, and $CF(CF_3)[OCF_2CF(CF_3)]_zOC_3F_7$, where z is zero or an integer from 1 to 10, inclusive.

Procedures for preparing the benzimidazole additives in which R is hydrogen, hydrocarbon alkyl, hydrocarbon aryl and perfluoroalkyl are described in the literature, e.g., in Elderfield's "Heterocyclic Compounds," John Wiley and Sons, New York, N.Y. An exemplary procedure disclosed in the literature for preparing various 2-substituted benzimidazoles can be represented by the following formulas:

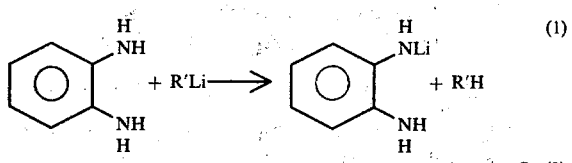

(1)

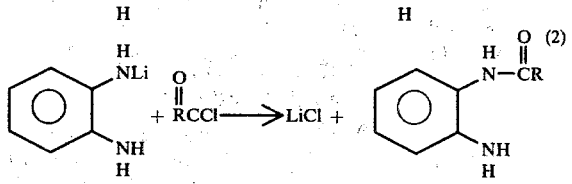

(2)

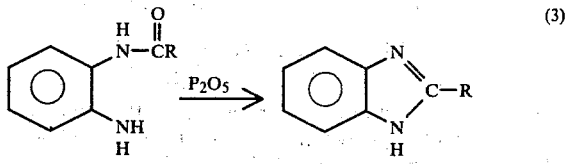

(3)

In equation (1), R′Li can be any suitable organolithium compound, e.g., one in which R′ is $CH_3$—, $C_4H_9$— or $C_6H_5$—. As seen from equation (2), the acid chloride

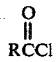

is the source of the R group, which can be, for example, a hydrocarbon alkyl, a hydrocarbon aryl or perfluoroalkyl group.

A procedure described in the literature for preparing 2-substituted benzimidazoles in which R is hydrocarbon alkyl can be represented by the following equation.

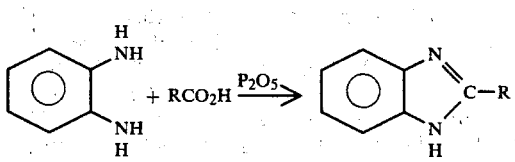

(4)

As seen from equation (4), a diaminobenzene is reacted directly with an aliphatic acid to give the benzimidazole.

The benzimidazoles in which R is a perfluoroalkyleneether radical are new compounds which can be prepared by a process which is not described in the literature. The process involed in their preparation is illustrated by the following equation:

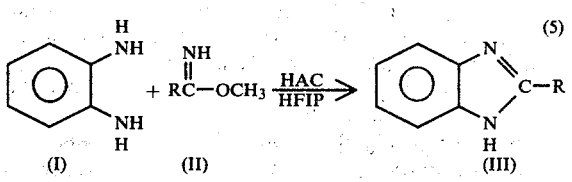

(5)

(I) (II) (III)

As shown by equation (5), diaminobenzene (I) is reacted with imidate ester (II) in the presence of glacial acetic acid (HAC), utilizing hexafluoroisopropanol (HFIP) as the reaction medium. The reaction temperature usually ranges from about 45 to 50° C. The reaction time usually ranges from about 1 hour to 4 or 5 days.

It is seen from equation (5) that the R group is derived from the imidate ester (II). The imidate esters are well known compounds that are described in the literature. For example, following the procedure described by H.

C. Brown and C. R. Wetzel in Journal of Organic Chemistry, 30, 3724 (1965), a variety of imidate esters can be synthesized from a variety of fluorine-containing nitriles. While the process is particularly suitable for preparing 2-substituted benzimidazole additives in which R is a perfluoroalkyleneether as described above, it can also be employed to synthesize benzimidazoles in which R is a perfluoroalkyl ($C_aF_{2a+1}$). A more complete discussion of the synthesis of the fluorine-containing benzimidazoles can be obtained by referring to our copending U.S. application Ser. No. 100,301, filed on Dec. 4, 1979, now U.S. Pat. No. 4,267,348, the disclosure of which is incorporated herein by reference.

A more comprehensive understanding of the invention can be obtained by referring to the following illustrative examples which are not intended, however, to be unduly limitative of the invention.

EXAMPLE I

A series of runs was conducted in which grease compositions of this invention were formulated and tested. As a base fluid there was used a fluorinated polysiloxane having the following formula:

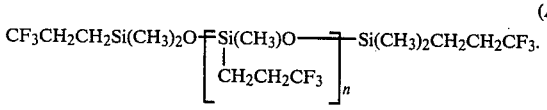

(A)

where n is an integer having a value such that the fluid has a viscosity of 75 centistokes at 100° F. The base fluid was a product of Dow Corning Corp., Midland, Mich., that was identified as FS-1265. The thickener used was a fluorinated copolymer of ethylene and propylene having a molecular weight of 150,000.

The benzimidazole additives used in the formulations had the following structural formula:

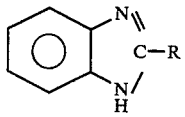

in which R was one of the following H, $C_6H_{13}$, $C_6H_5$, $CF(CF_3)OCF_2CF(CF_3)OC_3F_7$, and $CF(CF_3)[OCF_2CF(CF_3)]_4OC_3F_7$.

In preparing each of the greases, the components were mixed and stirred until a uniform mixture was obtained. The amounts of base fluid used ranged from 60 to 65 weight percent while the amounts of thickener used ranged from 34 to 39 weight percent. Each grease composition contained 1.0 weight percent of the above-defined benzimidazole additives. Each mixture was further blended to a grease consistency by passing it two times through a 3-roll mill with the rollers set at an opening of 0.002" at about 77° F.

The various grease compositions were tested according to several test procedures. The penetration test was conducted in accordance with Federal Test Method Standard 791a, Method 313.2. The rust preventive properties test was carried out in accordance with Method 4012 of the same standard. The high temperature corrosion was determined in accordance with the method set forth in Technical Documentary Report AFML-TR-69-290. The results of the test are set forth hereinafter in the table.

EXAMPLE II

A series of runs was conducted in which greases were prepared, utilizing, as described in Example I, the same thickener and benzimidazole additives and amounts thereof as well as the same amounts of a fluorinated polysiloxane base fluid. However, the fluorinated polysiloxane had the following structural formula:

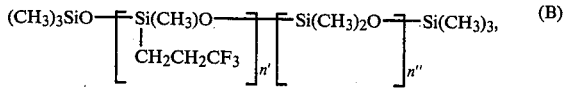

(B)

where n' and n'' are integers having values such that the fluid has a viscosity of about 80 centistokes at 100° F. The fluid was a product of Dow Corning Corp., Midland, Mich., that was identified as Q5-0167.

The greases were formulated and tested according to the procedures described in Example I. The results of the test are shown below in the table.

EXAMPLE III

A series of runs was carried out in which greases were prepared, utilizing, as described in Example I, the same base fluid and benzimidazole additives and amounts thereof as well as the same amount of thickener. However, the thickener used was polytetrafluoroethylene having a molecular weight of about 30,000.

The greases were formulated and tested according to the procedures described in Example I. The results of the tests are shown below in the table.

EXAMPLE IV

A series of runs was conducted in which greases were prepared, utilizing as described in Example II, the same base fluid and benzimidazole additives and amounts thereof as well as the same amount of thickener. However, the thickener used was polytetrafluoroethylene having a molecular weight of about 30,000.

The greases were formulated and tested according to the procedures described in Example I. The results of the tests are set forth in the table.

EXAMPLE V

Control runs were conducted in which greases were prepared, utilizing the base fluid and thickener of Examples I and II. The greases consisted of 65 weight percent base fluid and 35 weight percent thickener and did not contain any of the benzimidazole additives.

TABLE

| | Greases of Example I | Greases of Example II | Greases of Example III | Greases of Example IV | Grease(1) based Formula A fluid, no additive | Grease(1) based Formula B fluid, no additive |
|---|---|---|---|---|---|---|
| Penetration,(2) decimillimeters | 264–290 | 281–283 | 265–292 | 281–284 | 302–309 | 340–342 |
| Rust Preventive(3) | | | | | | |

TABLE-continued

| | Greases of Example I | Greases of Example II | Greases of Example III | Greases of Example IV | Grease[1] based Formula A fluid, no additive | Grease[1] based Formula B fluid, no additive |
|---|---|---|---|---|---|---|
| Properties | Pass[4] | Pass | Pass | Pass | Marginal[5] | Marginal |
| High Temperature[6] Corrosion 450° F., 72 hours | Pass | Pass | Pass | Pass | Fail[7] | Fail |
| 52-100 steel | Pass | Pass | Pass | Pass | Fail | Fail |
| 440C steel | Pass | Pass | Pass | Pass | Fail | Fail |
| M-10 steel | Pass | Pass | Pass | Pass | Fail | Fail |
| M-50 steel | Pass | Pass | Pass | Pass | Fail | Fail |

[1]Control runs
[2]Range of penetration of values of the various greases formulated in examples.
[3]Federal Test Method Standard 791a, Method 4012.
[4]Pass - No rusting or corrosion, a maximum of 3 spots allowed.
[5]Marginal - The maximum allowable number of rust spots were present at the end of the test.
[6]AFML-TR-69-290.
[7]Fail - More than 3 rust or corroded spots or pitting and etching.

The greases were formulated and tested according to the procedures described in Example I. The results of the test are included in the table.

The following examples, namely examples VI through XI, set forth specific grease formulations utilizing the benzimidazole additives of this invention.

EXAMPLE VI

65% Fluid given in Example I
34% Thickener given in Example I
1% Benzimidazole wherein R is H Penetration—264

EXAMPLE VII

65% Fluid given in Example II
34% Thickener given in Example II
1% Benzimidazole wherein R is $C_6H_{13}$ Penetration—281

EXAMPLE VIII

65% Fluid given in Example II
34% Thickener given in Example II
1% Benzimidazole wherein R is $CF(CF_3)OCF_2CF(CF_3)OC_3F_7$ Penetration—283

EXAMPLE IX

65% Fluid given in Example III
34% Thickener given in Example III
1% Benzimidazole wherein R is $C_6H_5$ Penetration—265

EXAMPLE X

65% Fluid given in Example IV
34% Thickener given in Example IV
1% Benzimidazole wherein R is $CF(CF_3)OCF_2CF(CF_3)OC_3F_7$ Penetration—281

EXAMPLE XI

65% Fluid given in Example IV
34% Thickener given in Example IV
1% Benzimidazole wherein R is $CF(CF_3)[OCF_2CF(CF_3)]_4OC_3F_7$ Penetration—284

From the data in the foregoing table, it is seen that the grease compositions of this invention do not cause rusting of ferrous metals under mild temperature and high humidity conditions or corrosion under conditions of high temperature. The antirust and anticorrosion properties of the greases are directly attributable to the presence of the benzimidazole additives. Thus, when the additives were omitted as in the control runs, rusting and corrosion of the ferrous metals occurred as a result of contact with greases based on fluorinated polysiloxane fluids.

As will be evident to those skilled in the art, modifications of the present invention can be made in view of the foregoing disclosure without departing from the spirit and scope of the invention.

We claim:

1. A grease composition comprising a major amount of a fluorinated polysiloxane base fluid, a minor amount of a thickening agent for the base fluid, and a rust and corrosion inhibiting amount of a benzimidazole having the following structural formula:

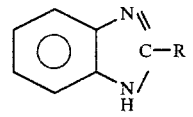

wherein R is hydrogen, hydrocarbon alkyl, hydrocarbon aryl, perfluoroalkyl or perfluoroalkyleneether.

2. The grease composition according to claim 1 in which the fluorinated polysiloxane base fluid has the following formula:

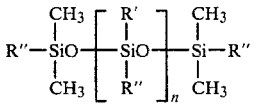

wherein R′ is hydrogen or an aliphatic hydrocarbon radical containing 1 to 3, inclusive, carbon atoms, R″ is methyl, ethyl, vinyl, phenyl or $—CH_2CH_2R'''$ in which R‴ is a perfluoroalkyl radical having 1 to 10, inclusive, carbon atoms with at least half of the R″ groups being —$CH_2CH_2R'''$, and n is an integer ranging from 1 to 150.

3. The grease composition according to claim 2 in which the thickening agent is a fluorinated ethylene-propylene copolymer or polytetrafluoroethylene.

4. The grease composition according to claim 3 which comprises about 60 to 65 weight percent of the base fluid, about 33.5 to 39.5 weight percent of the thickening agent, and about 0.5 to 1.5 of the benzimidazole, based upon a total of 100 weight percent.

5. The grease composition according to claim 4 in which R is hydrogen.

6. The grease composition according to claim 4 in which R is a hydrocarbon alkyl.

7. The grease composition according to claim 6 in which the hydrocarbon alkyl is $C_6H_{13}$.

8. The grease composition according to claim 4 in which R is a hydrocarbon aryl.

9. The grease composition according to claim 8 in which the hydrocarbon aryl is $C_6H_5$.

10. The grease composition according to claim 4 in which R is perfluoralkyl.

11. The grease composition according to claim 10 in which the perfluoroalkyl is $C_3F_7$.

12. The grease composition according to claim 4 in which R is perfluoroalkyleneether.

13. The grease composition according to claim 12 in which the perfluoroalkyleneether is $CF(CF_3)OCF_2CF(Cf_3)OC_3F_7$.

14. The grease composition according to claim 12 in which the perfluoroalkyleneether is $CF(CF_3)[OCF_2CF(CF_3)]_4OC_3F_7$.

* * * * *